US005371937A

United States Patent [19]

Watson et al.

[11] Patent Number: 5,371,937

[45] Date of Patent: Dec. 13, 1994

[54] METHOD FOR PRODUCING A COMPOSITE MATERIAL

[75] Inventors: William G. Watson, Cheshire; Ronald N. Caron, Branford, both of Conn.

[73] Assignee: Olin Corporation, New Haven, Conn.

[21] Appl. No.: 191,152

[22] Filed: Feb. 3, 1994

Related U.S. Application Data

[63] Continuation of Ser. No. 546,966, Jul. 2, 1990, abandoned.

[51] Int. Cl.[5] ..... B23P 17/00

[52] U.S. Cl. ..... 29/527.3; 104/46; 104/63; 104/66.1; 104/432; 427/569; 427/455; 427/421

[58] Field of Search ..... 29/527.3; 164/432, 46, 164/63, 66; 422/421, 422, 423, 34

[56] References Cited

U.S. PATENT DOCUMENTS

| | | | |
|---|---|---|---|
| Re. 31,767 | 12/1984 | Brooks | 29/527.2 |
| 3,775,156 | 11/1973 | Singer | 117/65.2 |
| 3,826,301 | 7/1974 | Brooks | 164/46 |
| 3,909,921 | 10/1975 | Brooks | 29/527.2 |
| 3,949,804 | 4/1976 | Kaneko et al. | 29/527.3 X |
| 4,047,933 | 9/1977 | Larson et al. . | |
| 4,066,117 | 1/1978 | Clark et al. | 164/46 |
| 4,302,483 | 11/1981 | Altorfer et al. | 427/423 X |
| 4,374,162 | 2/1983 | Takagi | 427/421 X |
| 4,420,441 | 12/1983 | Singer | 264/7 |
| 4,486,470 | 12/1984 | Stuck et al. | 427/421 X |
| 4,539,930 | 7/1985 | Stuck et al. | 427/421 X |
| 4,588,021 | 5/1986 | Bergeron et al. | 164/432 |
| 4,657,787 | 4/1987 | Singer et al. | 427/422 X |
| 4,804,034 | 2/1989 | Leatham et al. | 164/46 |
| 4,806,385 | 2/1989 | Timmons | 427/34 |

FOREIGN PATENT DOCUMENTS

| | | | |
|---|---|---|---|
| 0225080 | 6/1987 | European Pat. Off. . | |
| 1379261 | 1/1975 | United Kingdom . | |
| 1472939 | 5/1977 | United Kingdom . | |
| 2130250 | 5/1984 | United Kingdom | 437/34 |
| 2172900A | 10/1986 | United Kingdom . | |
| WO89/05870 | 6/1989 | WIPO . | |

OTHER PUBLICATIONS

Leatham, A. G. et al. "The Osprey Process for the Production of Spray-Deposited Roll, Disc, Tube and Billet Preforms", Modern Developments in Powder Metallurgy vols. 15-17, Metal Powder Industries Federation, Princeton, N.J., 1985 pp. 157-173.

Evans, R. W. et al. "The Osprey Preform Process", Powder Metallurgy, vol. 28, No. 1, 1985, pp. 13-20.

*Primary Examiner*—Carl J. Arbes

*Attorney, Agent, or Firm*—Gregory S. Rosenblatt

[57] ABSTRACT

A method of making a composite material in which a porous preform is produced by spray casting. An appropriate metal or alloy is caused to infiltrate the interconnected pores. This may be accomplished by infiltrating the porous preform with a liquid metal of a melting point lower than the melting point of the porous preform and thereafter solidifying the infiltrated material or the material can be infiltrated by the use of a slurry containing the desired particles and the liquid carrier driven off by baking the infiltrated preform. Alternatively, infiltration may be accomplished by plating of a desired metal or alloy from an appropriate infiltrate electroplating or electro-less plating solution.

11 Claims, 1 Drawing Sheet

METHOD FOR PRODUCING A COMPOSITE MATERIAL

This application is a continuation of application Ser. No. 07/546,966, filed Jul. 2, 1990 now abandoned which is incorporated herein by reference in its entirety.

BACKGROUND OF THE INVENTION

1. Field of the Invention

This invention relates generally to a method for making a composite material. More particularly, this invention relates to the method of making a composite material with three dimensional interconnectivity.

2. Background Information

In the past, various composite materials have been made consisting of two different metals or alloys in order to enhance the properties of each of the two ingredients.

One way of making such a composite in which a second material is dispersed throughout a first material as a discrete phase is by powder metallurgy techniques. In powder metallurgy, the two materials are first formed into powders. The powders are then mixed together and consolidated into a discrete shape. The consolidated shape is then sintered to obtain structural integrity.

SUMMARY OF THE INVENTION

In accordance with the present invention, a method is disclosed for producing a composite in which a second material fills the interconnected pores of a preform. The method of the present invention simplifies the number of steps required to form a composite as compared to powder metallurgy. Additionally, the present invention permits starting with a preform or matrix material having structural integrity. The porous preform is made by spray casting with the interconnected pores thereof subsequently infiltrated with an appropriate metal or alloy.

One of the microstructural features typically associated with spray cast deposits is a highly-porous bottom surface region. This porosity is a consequence of insufficient liquid being present to fill the intersticies between adjacent splats. It has been noted that this porosity is interconnected. Normally when making strip material this porosity must either be eliminated or removed prior to subsequent thermo-mechanical processing of the spray cast product. However, if the spray cast conditions are controlled, the three dimensional network of interconnected porosity can extend throughout the thickness of the spray cast preform or substantially therethrough. This preform may then be infiltrated with a desired material to form a composite.

Accordingly, in accordance with the present invention, there is provided a method of making a composite material with three dimensional interconnectivity of a second material comprising producing a porous preform by spray casting, and infiltrating the interconnected pores with the second material.

DETAILED DESCRIPTION

Figure 1:
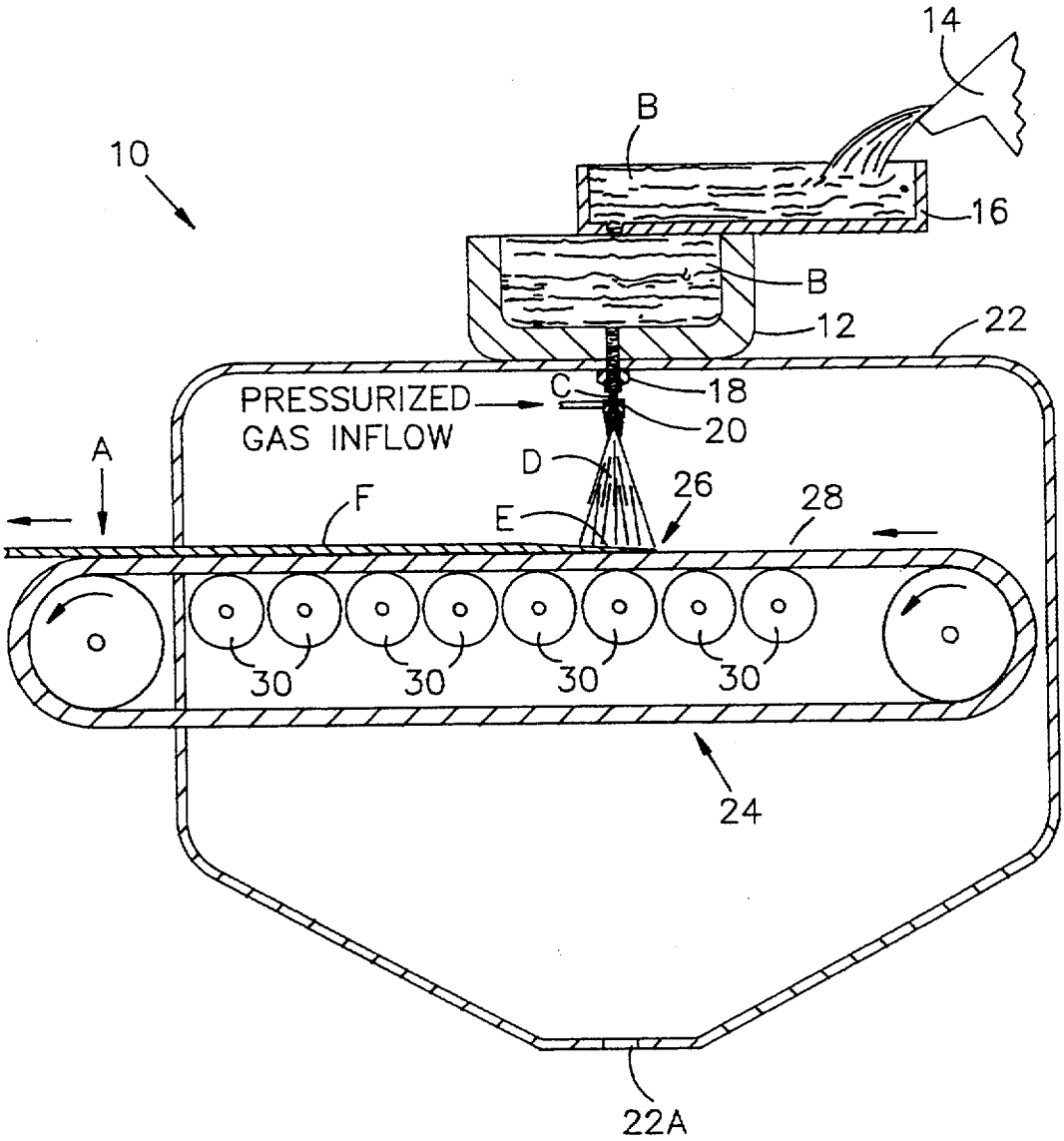
FIG. 1 is a schematic view, partially in section, of a spray deposition apparatus which may be used to produce a preform for infiltration with the appropriate liquid, metal or alloy.

In accordance with the present invention, a preform in an appropriate shape is first prepared by spray casting under such conditions as to provide interconnected porosity. A typical spray cast apparatus capable of making a preform according to this invention is shown in FIG. 1. The spray-deposition apparatus 10 shown therein is adapted for formation of a product A in the form of a thin gauge metal strip. An example of such suitable metal B is a copper alloy.

The spray-deposition apparatus 10 employs a tundish 12 in which the metal B is held in molten form. The tundish 12 receives the molten metal B from a tiltable melt furnace 14, via a transfer launder 16, and has a bottom nozzle 18 through which the molten metal B issues in a stream C downwardly from the tundish 12.

A gas-atomizer 20 employed by the apparatus 10 is positioned below the tundish bottom nozzle 18 within a spray chamber 22 of the apparatus 10. The atomizer 20 is supplied with a gas, such as nitrogen, under pressure from any suitable source. The atomizer 20 which surrounds the molten metal stream C impinges the gas on the stream C so as to convert the stream into a spray D of atomized molten metal particles. The particles broadcast downwardly from the atomizer 20 in the form of a divergent conical pattern. If desired, more than one atomizer 20 may be used. Also, the atomizer(s) can be moved transversely in side-to-side fashion for more uniformly distributing the molten metal particles.

A continuous substrate system 24 is employed by the apparatus 10 and extends into the spray chamber 22 in a generally horizontal fashion and in spaced relation below the gas atomizer 20. The area 26 of the substrate upper run 28 directly underlies a divergent spray pattern of spray D for receiving thereon a deposit E of the atomized metal particles to form the metal strip product A. The metal strip product A is carried from the spray chamber 22 by the substrate system 24 from which it is removed by suitable mechanism (not shown). A fraction of the particles overspray the substrate 24, solidify and fall to the bottom of the spray chamber 22 which, along with the atomizing gas, flow from the chamber via exhaust port 22*a*.

The substrate system 24 may have a surface to receive the deposit which is fabricated from a material of the type to help insure adequate porosity in the spray cast product. Such a material should be one which is of relatively high thermal conductivity such as steel so as to cause fairly rapid cooling of the metal particles contacting the substrate. Additionally, the ratio of gas to metal should be relatively high to provide a cooler spray so there is generally insufficient liquid material present in the deposit to fill the intersticies between adjacent splats as the material is being deposited and layered one on top of the other on the substrate.

With the proper control of the gas to metal ratio in combination with a substrate of relatively high thermal conductivity, a preform product can be formed by the spray cast process which has interconnected porosity throughout its thickness. As indicated above, this porosity is thought to occur when the deposit layers are cooled too rapidly by the substrate to provide sufficient liquid to feed the inherent intersticies between the splatted droplets. The resulting product comprised of a controlled amount of interconnected porosity may then be cut into a desired shape or used in strip form as the preform for infiltration with a second material to form the composite.

In accordance with one aspect of this invention, the porous preform material may be infiltrated with a lower melting point metal or alloy to produce a composite structure with three dimensional interconnectivity of each phase. This may be accomplished by melting the desired addition metal or alloy and directly immersing the preform into a bath of the molten material so that the material infiltrates the pores. If necessary, the infiltration of the molten metal can be assisted by vacuum assisted techniques. Generally, with such a technique, one side of the preform is placed in contact with the molten material and the other side supplied to a vacuum to draw the molten metal into the preform. The product may then be further processed by cooling either by the application of cooling air or otherwise so that the infiltrated material solidifies. If desired, the infiltrated preform may be further treated by rolling, forging or extrusion.

Examples of composites that may be formed by this technique include filling the pores of a copper or copper alloy preform with pure lead or with Babbitt alloys to create a composite which would provide a high-conductivity, free-machining stock alloy or bearing alloy, respectively. Additionally, higher strength multi-phase composites can be manufactured by infiltration of aluminum, magnesium, tin, zinc and/or their respective alloys into a copper preform.

In accordance with another aspect of the present invention, materials to be infiltrated may comprise a slurry containing discrete particles for incorporation into the copper porous preform. The particles to be infiltrated would be dispersed in a carrier liquid to form the slurry. The porous preform would be immersed in the slurry and the slurry permitted to infiltrate into the pores. Vacuum assist could be used if necessary. The carrier liquid would then be baked off leaving the particulate phase behind within the porous preform. Such infiltrated preform should then be subsequently processed by cold rolling, extrusion or forging to bond and disperse the particulate in the originally spray cast material creating a composite with enhanced or unusual properties depending upon the infiltrated material.

For example, by using a slurry, a solid lubricant material such as $MoS_2$, graphite, talc or boron nitride could be incorporated into a porous solid metal preform such as copper to provide good machineability, wear resistance or a lubricious surface. In addition, hard oxide particulate such as alumina or silicon carbide may be incorporated into a copper preform to enhance the strength, elevated temperature stability and wear resistance. Any suitable carrier liquid may be used such as alcohol to form the slurry.

A third aspect of this invention involves the incorporation of the second material into the porous preform by the use of electroplating or electro-less plating solution containing a source of ions of the desired material to be infiltrated. This technique would be especially adaptable to the incorporation of higher melting point materials into the preform.

According to this aspect of the present invention, the plating solution is caused to infiltrate into the porous preform as by immersion or dipping of the preform into the solution. In the case of electroplating solutions, suitable current is caused to pass between the infiltrated preform and an anode with the preform being the cathode so that the ions of the desired material are deposited on the walls of the pores in the preform material.

In the case of electro-less plating, any suitable electro-less plating solution may be used. The solution is infiltrated into the pores by immersion of the preform into a bath of the solution. The solution within the pores should then be replenished as by bath agitation or stirring as required to provide the desired amount of the deposit on the walls of the pores.

Such infiltrated preforms with the deposited material therein may be subsequently processed as by cold rolling, extrusion, or forging. Before, between or following these processing steps, the infiltrated preform may be heat treated if desired to improve bonding at the preform/infiltrant interface or to form desirable compounds at the interface. Examples of such products which may be obtained this way is a preform of copper with tungsten or superconductive ($Nb_3Sn$) phases dispersed throughout.

While the invention has been described above with reference to specific embodiments thereof, it is apparent that many changes, modifications and variations can be made without departing from the inventive concept disclosed herein. Accordingly, it is intended to embrace all such changes, modifications and variations that fall within the spirit and broad scope of the appended claims.

What is claimed is:

1. A method of making a composite material with three dimensional interconnectivity of a second material comprising:

producing a porous preform by spray casting;

preparing an electroless plating solution containing ions of said second material;

infiltrating the electroless plating solution within the pores of said porous preform; and depositing said second material on the walls of said pores.

2. A method of making a composite material with three dimensional interconnectivity of a second material, comprising:

producing a porous preform by spray casting;

preparing an electroplating solution containing ions of said second material;

infiltrating the electroplating solution within the pores of said porous preform; and electrolytically depositing said second material on the walls of said pores.

3. A method of making a composite material, comprising:

spray casting a first material to form a preform having interconnected porosity; and infiltrating said interconnected porosity with a second material, said second material having a lower melting temperature than said first material.

4. The method of claim 3 wherein said interconnected porosity is infiltrated with a liquid metal or metal alloy and then cooled to solidify said liquid metal or metal alloy.

5. The method of claim 4 wherein said infiltrating step is by immersion of said preform into said liquid metal or metal alloy.

6. The method of claim 4 wherein said infiltrating step is vacuum assisted.

7. The method of claim 4 wherein said first material is copper and said second material is selected from the group consisting of lead, Babbitt alloys, aluminum, magnesium, tin, zinc and alloys thereof.

8. The method of claim 3 wherein said second material is a slurry having a carrying liquid phase and a particulate phase.

9. The method of claim 8 wherein subsequent to said infiltrating step, said carrying liquid phase is baked off and said particulate phase is deposited within said preform.

10. The method of claim 8 in which said particulate phase is selected from the group consisting of $MoS_2$, graphite, talc and boron nitride and said first material is copper or a copper base alloy.

11. The process of claim 8 wherein said particulate phase contains hard oxide particles.

* * * * *